United States Patent [19]

Strohm, Jr.

[11] Patent Number: 4,682,637

[45] Date of Patent: Jul. 28, 1987

[54] LINEAR WEAVING MACHINE

[76] Inventor: Wilbur J. Strohm, Jr., 2817 Via Segovia, Palos Verdes Estates, Calif. 90274

[21] Appl. No.: 752,652

[22] Filed: Jul. 8, 1985

[51] Int. Cl.[4] ..... B21F 27/02

[52] U.S. Cl. ..... 140/9; 87/34

[58] Field of Search ..... 140/5, 6, 7, 8, 9, 35; 139/11; 28/141; 87/33, 34

[56] References Cited

U.S. PATENT DOCUMENTS

| | | | |
|---|---|---|---|
| 412,369 | 10/1889 | Drawbaugh | 87/34 |
| 1,009,994 | 11/1911 | Parrish | 140/9 |
| 1,075,375 | 10/1913 | Parrish | 140/9 |
| 1,076,831 | 10/1913 | Kilmer | 140/9 |

FOREIGN PATENT DOCUMENTS

| | | | |
|---|---|---|---|
| 514477 | 3/1921 | France | 140/9 |

*Primary Examiner*—Robert L. Spruill
*Assistant Examiner*—Donald R. Studebaker
*Attorney, Agent, or Firm*—Christie, Parker & Hale

[57] ABSTRACT

A high-speed wire fence weaving apparatus for making wire mesh fencing. The apparatus provides a first stage where a high-speed transfer mechanism moves large spools of wrap wire in a weaving pattern about a plurality of strand wires. The strand wires and wrap wires are pulled from the first stage to a second stage which is relatively remotely spaced from the first stage to permit the wires to be guided into a more closely confined relation to one another. The second stage also has a transfer mechanism which moves in synchronism with the first transfer mechanism to weave the wrap wires between and around the strand wires to produce a diamond-mesh pattern. Thereafter, the mesh is pulled to a take-up location by the apparatus.

37 Claims, 19 Drawing Figures

LINEAR WEAVING MACHINE

BACKGROUND OF THE INVENTION

The present invention relates to machines for making wire mesh and, in particular, to a high-speed, high-production wire mesh fence-making apparatus.

Typically, such wire mesh consists of a first plurality of spaced-apart parallel wires called strand wires and a second plurality of parallel wires that diagonally cross and are wrapped around the strand wires. This second plurality of wires is called wrap wires. The second plurality of wires typically consists of two sets, a first set that crosses the strand wires at a first angle and a second set that crosses the strand wires and first set of wrap wires at a second angle such that the first and second set of wrap wires define a diamond-shaped mesh pattern technically known as "Elwood fabric."

In fence-making apparatus according to the prior art, a first set of spools of wire supplying the wrap wires were arranged to rotate around the strand wires and shuttle from strand wire to strand wire in a weaving pattern. A second set of spools supplied the strand wires. The movement of the first set of spools wrapped the wire from the wrap-wire supply around each strand forming a diamond mesh that consisted of parallel strand wires and wrap wires that crossed the strand wires at an angle and wrapped around each one at each crossing point.

In operation, the strand wires are pulled at a predetermined rate from their supply spools through the wrapping area. The rate of speed at which the strand wires were pulled and the shuttling speed of the wrap-wire spools determined the spacing between the adjacent wrap wires and the angle that the wrap wires formed with respect to the strand wires.

According to the prior art, as represented by such patents as U.S. Pat. No. 1,076,831, such fence-making machines used narrow spools which are elongated in the longitudinal direction for containing the wrap wires. The size of the spools was kept narrow in order to enable them to be moved between the relatively closely spaced strand wires without interference. The narrow size of the spools dictated that the spools carried a relatively small quantity of wire, and the fence-making machine had to be stopped frequently to replace empty spools and to insert new spools. Then, before the weaving operation could recommence, the wire from the new spools was welded end-to-end to the strand wires from the old spools. Not only was the fence-making apparatus according to the prior art slow because of the constant replacement of spools and welding of wires, but such fence-making apparatus was characterized by problems caused by the fact that the individual wrap wires were usually twisted in the longitudinal direction. This was due to the fact that the strand-wire spools were vertically oriented and the strand wires were pulled upwardly from the outside of the spools, thereby causing a twist to be imposed on the wrap wires. This led to problems in smooth operation of the machine and inconsistencies in the quality of the wire mesh fabricated thereby.

The production rate of the fence-making apparatus according to the prior art was further inhibited by the start-and-stop nature of the weaving operation. Operation in this fashion was dictated by the fact that the machine would normally be momentarily stopped after the spools of wrap wire had been wrapped around a given strand wire. Stopping of the spools permitted the release of the spool from its operative relation with respect to the strand-wire spindle about which it had just been rotated to permit its transfer to the next adjacent strand spindle. Once the transfer had been accomplished, the machine was restarted to permit translation to and rotation about the new strand wire.

SUMMARY OF THE INVENTION

The present invention provides an apparatus for making wire-mesh fencing with comprises a first stage having a plurality of supply spools from which a plurality of individual strand wires is pulled. The strand wires are arranged and guided by the apparatus in a converging pattern to a weaving area.

In the first stage the apparatus also includes a plurality of spaced-apart rolls of strand wires. The strand wires are unrolled and pulled from the first stage to a second stage remotely spaced from the first stage where the strand wires converge together to the desired spacing in the mesh fencing to be produced by the apparatus.

In the first stage, a plurality of spools of wrap wire are placed in baskets with the longitudinal axis of the spools vertically oriented. The spool baskets are spaced in a generally linear pattern relative to each other on a rotating shuttle and transfer table to permit the baskets to be moved back and forth along the line of orientation in a weaving pattern about the strand wires. The wrap-wire spools are wound such that the wrap wires are pulled from the interior of each spool rather than the exterior as in the prior art. The wrap wires are also guided in a converging pattern from the first stage to the weaving area.

A second shuttle and transfer mechanism in the weaving stage receives and guides the wrap wires in synchronism with the first shuttle and transfer mechanism, interweaving and wrapping the individual wrap wires around the individual strand wires creating a generally diamond-shaped mesh pattern of fencing of a predetermined width. The newly formed section of woven fencing is then pulled from the weaving stage and guided to a takeup stage where it is rolled up.

In contrast to the prior art, the present invention provides a wire-mesh fabricating apparatus which operates at high speed for long periods of time resulting in substantially higher production rates. The present invention provides such high-speed operation by separating the location of the supply area of the individual strands of wrap and strand wire from the location of the weaving area. By separating the two areas, the physical dimensions of the wire supply can be greatly expanded in size to accommodate spools of significantly increased volume. In a typical embodiment of the present invention, supply spools of wrap wire having at least ten times the volume of the prior art wrap wire supply spools are utilized. The result is that the fence-making apparatus according to the present invention can run continuously for much longer periods of time without stopping to resupply.

The present invention is also characterized by a shuttle and transfer mechanism in the supply stage and the weaving stage which operates continuously rather than in a start-and-stop fashion which is characteristic of the prior art. The smooth continuous operation of the apparatus of the present invention also contributes significantly to its higher production rates.

The unique design of the present invention permits the spools of wrap wire to be placed in baskets with the longitudinal axis of the spools being vertically oriented. The spools of wire are specially wound so that the wrap wire is withdrawn from the interior of the spool rather than from the exterior of the spool as is characteristic of the prior art. By withdrawing the wrap wires from the interior of the spool, the longitudinal twisting of the strand wires which was characteristic of the prior art is reduced or eliminated, thereby eliminating kinking and other deformities which were characteristic of fencing produced by the prior art fence-making apparatus. The baskets for receiving the spools of wrap wire are mounted on a shuttle and transfer mechanism and move in unison with a second shuttle and transfer mechanism in the weaving area. The supply spool baskets are arranged such that the top of the basket is closed by means of a quick-release strap that permits rapid loading of the full coils or spools of wire into the basket and rapid removal of empty ones.

Due to the unique nature of the fence-making apparatus in the present invention, the wires utilized as the strand wires can be single, double, triple and even quadruple strand forms of wire or cable.

In a preferred embodiment according to the present invention, a single strand of wire is utilized as the strand wire and is subjected to crimping which is imparted to the strands at regularly spaced intervals along the length of the strand wire to provide a point of purchase and anchoring for the wrap wires which are wrapped thereabout. In this embodiment, the present invention is characterized by the ability to fabricate wire mesh fencing utilizing only single strands of wire at each strand interval rather than multiple strands of wire, thereby resulting in significant savings in the amount of wire required in order to fabricate a given length of fencing.

BRIEF DESCRIPTION OF THE DRAWINGS

The foregoing features and other details of the wire-weaving apparatus according to the present invention will be better understood by reference to the following figures of the drawing wherein.

DESCRIPTION OF A SPECIFIC EMBODIMENT

Figure 1:
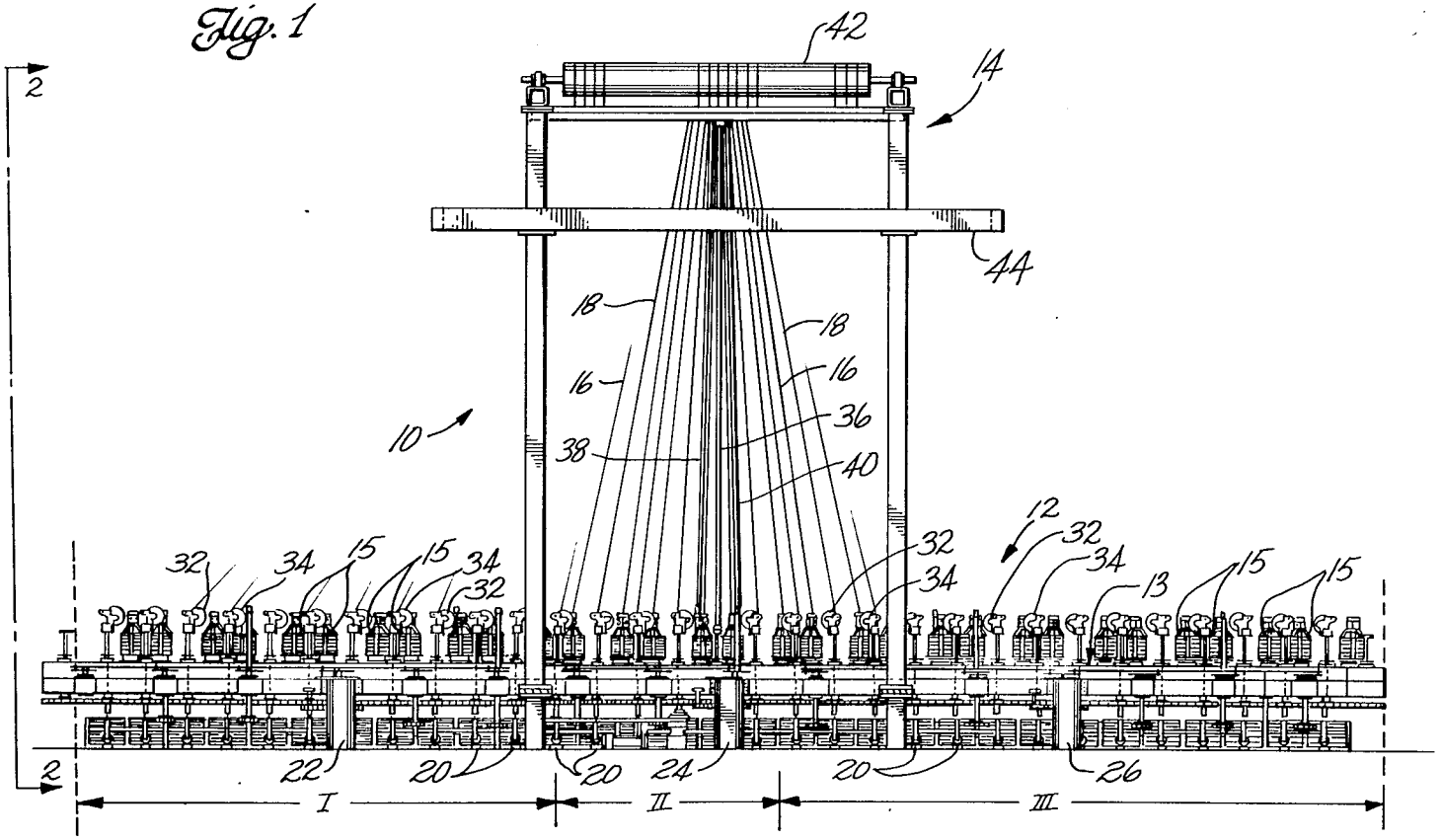
FIG. 1 is a front elevation view of the weaving apparatus showing the strand-wire supply, the wrap-wire supply baskets, the support assembly, the fence-weaving areas, and the fencing guide roller.
Figure 2:
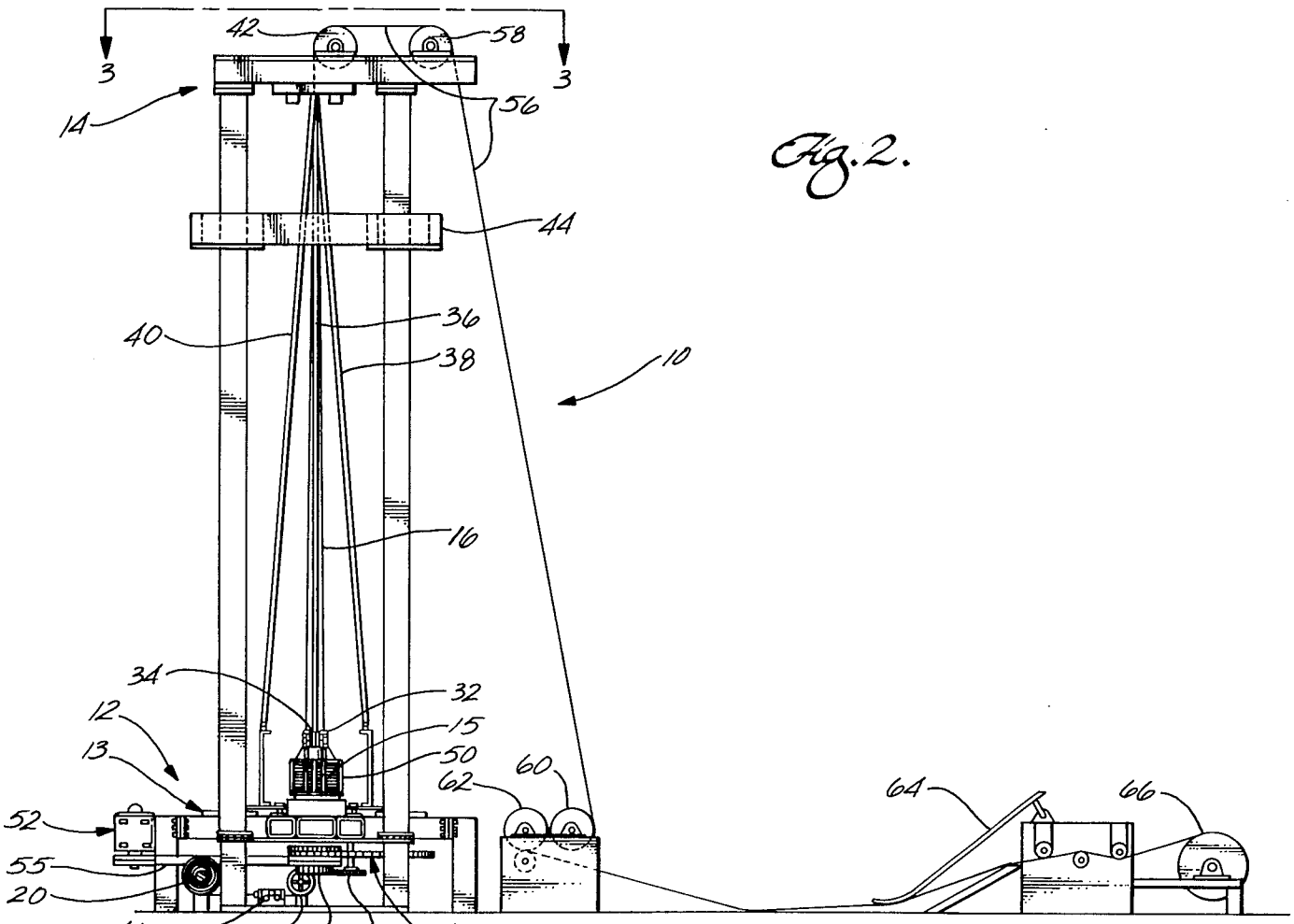
FIG. 2 is a side elevation view of the apparatus shown in FIG. 1.
Figure 3:
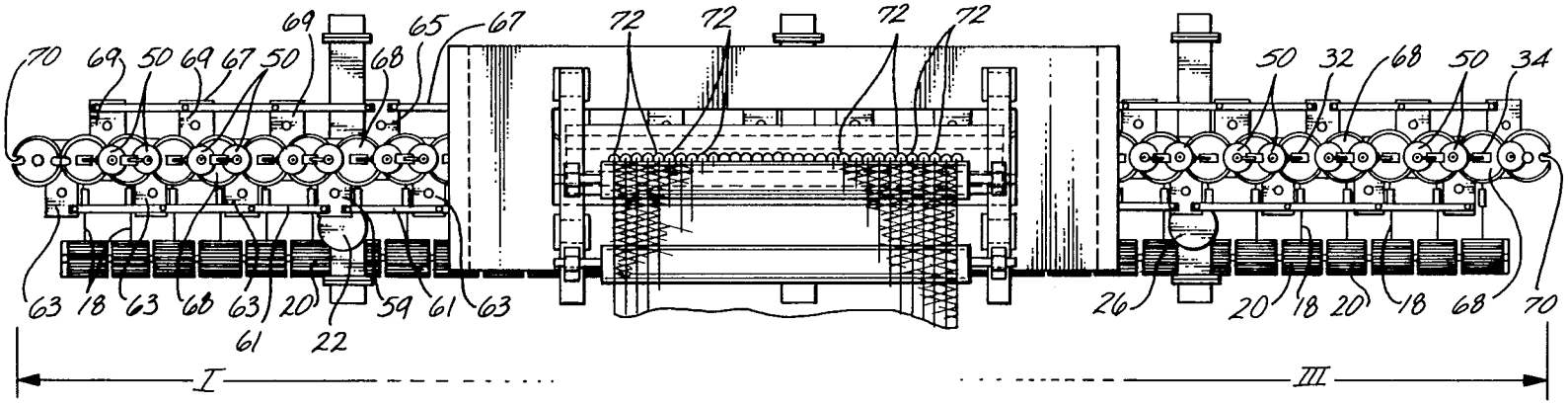
FIG. 3 is a plan view of the apparatus in FIG. 1.

An elevational view of a fencing-making apparatus according to the present invention is shown in FIG. 1. Side elevational and plan views of the apparatus of FIG. 1 are shown in FIGS. 2 and 3. The description which follows refers interchangeably to FIGS. 1, 2, and 3. The weaving apparatus 10 comprises a lower supply stage 12 and an upper weaving area 14. Supply stage 12 comprises a bed 13 upon which are mounted a plurality of wire spools 15. The wire spools are mounted on rotatable drive discs on bed 13 as will be more fully described below. As can be seen in FIG. 1 and other figures of the drawing, the wire spools 15 are mounted with their longitudinal axis of rotation in a vertical orientation. Furthermore, the wire on each set of the spools 15 is wound in such a manner that the wire is withdrawn from the interior of the spool. The wires contained in spools 15 are the wrap wires which are woven or wound about strand wires to provide the fencing product produced by the present apparatus. In FIG. 1 wires designated with reference numeral 16 are representative of the wrap wires which are withdrawn from spools 15 and carried upwardly to weaving area 14, where the actual interweaving of the strand wires and the wrap wires takes place.

Also shown extending in a generally vertical direction from supply stage 12 to weaving area 14 is a plurality of wires designated with reference numeral 18. The strand wires are supplied from a plurality of strand-wire-supply spools 20 located below bed 13 in the supply area 12. The strand wire spools are oriented with their axis of rotation disposed horizontally. As drive power is supplied to apparatus 10, strand wires are drawn from each of the supply spools 20 upwardly from supply area 12 through bed 13 to weaving area 14. Similarly, as drive power is being supplied to the apparatus, the wrap wire spools 15 are shuttled back and forth along bed 13, and at the same time, wire 16 is withdrawn from each of spools 15 and carried upwardly to the weaving area where the fabrication of the fencing takes place.

To simplify the understanding of the present invention, the illustration of the apparatus in FIG. 1 shows only a portion of the strand wires 18 and the wrap wires 16 extending from their respective supply spools to weaving area 14. The overall physical size of the apparatus, both in terms of its width and height, depends upon the height of the fencing to be produced by the apparatus. To fabricate an eight-foot fence requires twice as many supply spools of wrap wire and strand wire as to fabricate a roll of fencing that is four feet high. In FIG. 1 the apparatus 10, as illustrated, is divided into three sections designated by I, II, and III. In Section I, a cam driver 22 and its associated cam are mechanically linked to a shuttle tie rod and thereby provide the driving force for moving supply spool 15 in Section I in a shuttling back-and-forth motion through Section I of the apparatus. Similarly, cam driver 24 provides the driving force for shuttling the supply spools 15 in Section II. A third cam driver 26 forms a similar function in Section III of the supply area of apparatus 10.

As can be seen from FIG. 1, wire from each of the strand wire supply spools 20 is pulled from the supply spools in a direction moving first out of the plane of the drawing and then guided around a 90° angle upwardly through wire tensioning mechanisms 32 and then upwardly to weaving area 14. Similar wire tensioning mechanisms 34 are also mounted on top of the baskets which hold the wrap wire spools. The purpose of the tensioning mechanisms 32, 34 are to maintain a proper amount of tension on the strand wires and the wrap wires so that the wires are held straight and taut as they are pulled from their supply spools in the supply area, transition to the second or upper stage, and are wrapped by means of a shuttle mechanism in the weaving area 14. A drive shaft 36 for producing rotation of the weaver heads in the weaving area is shown in the center of FIG. 1. Shown on either side of drive shaft 36 extending upwardly from supply area 12 to weaving area 14 are a pair of upper shuttle drive rods 38, 40. Drive rod 38 extends to a shuttle tie rod which interconnects the shuttles in the weaving stage 14.

Spool wires and wrap wires are drawn from their respective supply spools at predetermined rates. The fencing produced by this apparatus has a diamond-shaped mesh pattern that is shown in FIG. 3. Depending upon the rate at which the strand wires are drawn through the weaving area, the size of the diamond-shaped mesh is quite small when the strand wires move slowly and grows larger as the strand wires are moved faster.

After the strand wires and wrap wires have been interwoven in the weaving area 14 to create the diamond mesh fencing, the fencing is guided by means of roller 42 out of the weaving head area and thereafter to a take-up area, as is shown in FIG. 2. A platform 44 is provided below the weaving head area 14 to permit access for observation of apparatus operation and for purposes of repair and maintenance in the upper portions of the apparatus 10.

As shown in FIG. 2, strand wire 18 is withdrawn from spool 20 and passes through a tensioning mechanism 46 around a pulley 48 to change the direction of the path of the wire and direct it vertically upwardly through the center of bed 13, and thence upwardly through a second tensioning mechanism to the weaving head area. A wrap wire spool 15 in a basket 50 is also shown in FIG. 2. As shown therein two wires extend upwardly through tensioning mechanisms 32 and 34 to the weaving head area. Power is supplied to the apparatus by means of a motor 52, which in turn is connected to driven gear 54 by drive belt 55. By proper gearing shown at 56, motor 52 imparts rotating drive motion to the apparatus to turn the shuttle drive rods 38, 40 and the drive shaft 36. After passing around guide roller 42, the fencing 56 is guided by means of a second guide roller 58 to a pair of tensioning rollers 60, 62 and thence past an idler arm 64 to a take-up spool 66. The idler arm is used to detect a minimum amount of tension in the fencing, so that the weaving apparatus doesn't overdrive or drive too rapidly. When the fencing becomes too slack, the idler arm is wired to the weaving apparatus 10 to shut it off until the take-up roller can take up the slack and put a predetermined amount of tension back into the fencing. Similarly, in the event that the take-up roller is moving too fast for the weaving apparatus and too much tension is placed in the fencing being produced by the apparatus, the idler arm will sense this condition as well and shut down the take-up roller 66.

The top plan view of the apparatus is seen in FIG. 3. As shown therein, Section I and III of the supply stage of the apparatus 10 are shown in the plan view. The baskets 50 containing the wrap wire are shown at spaced intervals between tensioning mechanisms 32, 34. Drive turntables or disks 68 are illustrated in FIG. 3 and are more fully detailed in subsequent figures of the drawing. Disks 68 rotate about a vertical axis. Slots 70 are provided on opposite sides of disks 68 for engaging a drive rod or stud on the underside of baskets 50. Each drive turntable 68 rotates in the opposite direction with respect to the two drive disks on either side of it. By means of a camming mechanism, supply baskets 50 are transferred or shuttled from drive disk to drive disk until they reach the end of their respective section (I, II, and III), at which time the baskets begin to move back in the opposite direction through their section to the last drive disk platform in each respective section. Cam drivers 22, 26 are shown in plan view of FIG. 3. A spool basket shuttle 59 is connected in a driven relationship to cam driver 22. Two shuttle tie rods 61 extend from shuttle 59 in opposite directions and are linked in driving relationship to driven shuttles 63. Shuttle 65 opposite cam driver 22 is also linked in a driven relationship to cam driver 22. Two shuttle tie rods 67 extend from shuttle 65 and are connected to driven shuttles 69.

As seen in FIG. 3, the strand wires and the wrap wires are guided upwardly from the supply area to the weaving area and ultimately through the weaving head disks 72, where the weaving operation takes place and the diamond-mesh fencing is created.

Similarly, a set of spool basket shuttles, shuttle drive rods and driven shuttles are operatively linked to cam drivers 22, 26.

Figure 4:
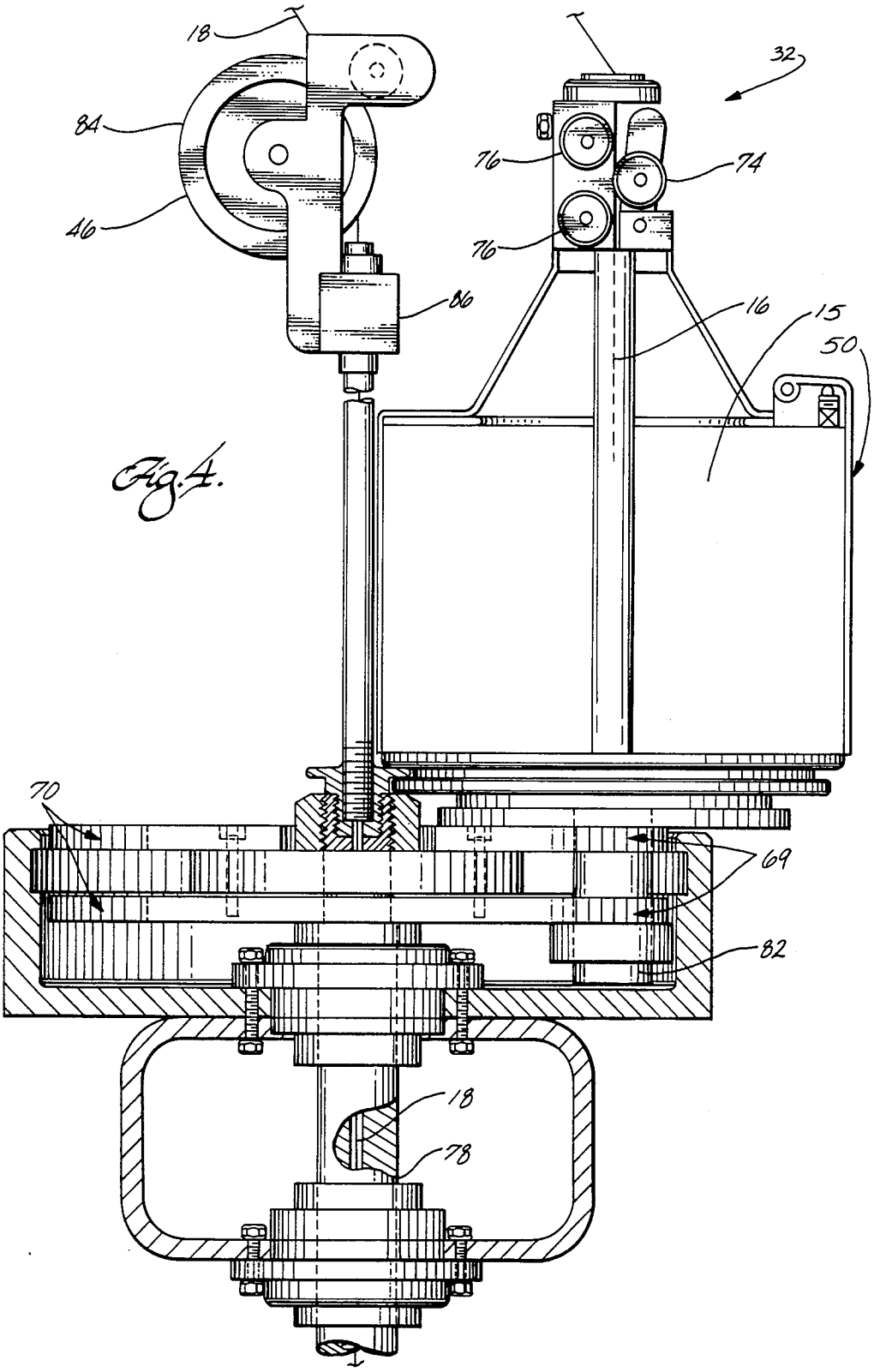
FIG. 4 is an elevation view in section of a wrap-wire supply basket, the basket drive assembly, a strand-wire guide roller, and a wrap-wire tensioning guide roller assembly.

Further details of the elements of the supply portion of the apparatus are shown in a sectional view in FIG. 4. As seen therein, a spool basket 50 for holding a vertically oriented spool of wire is provided. Wrap wire 16 is drawn from the interior of spool 15 and is then carried through tensioning mechanism 32 and directed upward toward the weaving area. The tensioning mechanism 32 consists of three grooved rollers 74, 76. Rollers 76 bear against the wrap wires from one side and roller 74 bears against the wrap wire from the opposite side to thereby ensure that the wire is under tension as it passes through mechanism 32.

As seen in the broken-away sectional view at the bottom of FIG. 4, the strand wire 18 extends upwardly through spool drive shaft 78. Under the impetus of the drive motor 52 for the apparatus spool drive shaft 78 rotates and turns the drive disk 69. A spool basket stud 82 extends downwardly from the base of basket 50 and is periodically engaged by slot 70 in disk 69 to provide the rotation and shuttling translation of each spool basket during the weaving operation.

Figure 5:
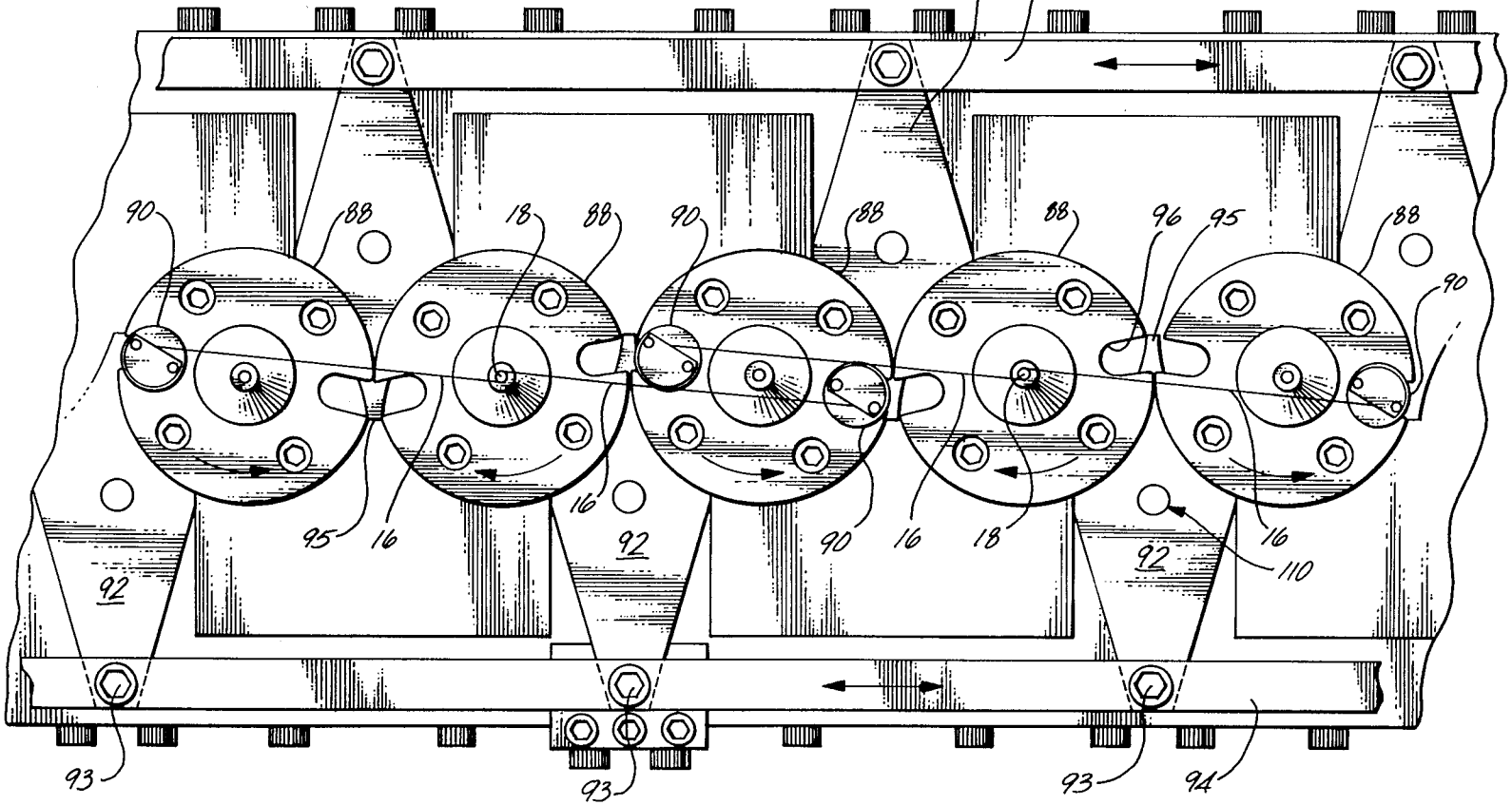
FIG. 5 is a plan view of the wire-weaving stage of the apparatus showing a plurality of wire-weaving heads.

A detailed plan view of the weaving area is shown in FIG. 5. A plurality of weaving head disks 88 is disposed in a side-by-side relationship. Wrap wires 16 extend upwardly through wrap die 90 and thence at an angle are drawn around strand wire 18. The weaving heads 90 rotate under the drive disks 88 and transfer from disk to disk under the influence of shuttle 92.

As can be seen from FIG. 5, for each section of fencing there are a series of five driving disks and four wrap-wire weaving heads. Strand wires 18, which may be single strands or twisted strands of two or more wires, extend upwardly through apertures in each disk 88. The direction of rotation of each disk is shown in FIG. 5. Each adjacent disk rotates in the opposite direction to the drive disk on either side thereof.

In operation, wrap die 90 at the extreme right-hand side of the drawing in FIG. 5 rotates twice around in a counterclockwise direction for 720° until it approaches the next adjacent disk. Shuttle 92 is mechanically linked to shuttle tie rod 94. As shuttle tie rod 94 shifts to the left, the tails 91 of shuttles 92 move to the left, pivoting about axis 110, and the tongues 95 of the shuttles shift to the right, providing a guide for wrap die 90 transferring it to slot 96 in next adjacent drive disk 88. The wrap die 90 makes one and one-half revolutions around drive disk 88 traveling through 540° and is then transferred to next adjacent drive disk 88 as shuttle tie rod 94 shifts to the right and left, thereby enabling the tongue 95 of the shuttle to provide a guide for weaving head 90 whereby the transfer to middle drive disk 88 is accomplished, at which time the weaving head 90 reverses its path of travel from disk to disk and moves back in sequence from left to right in FIG. 5.

Figure 6:
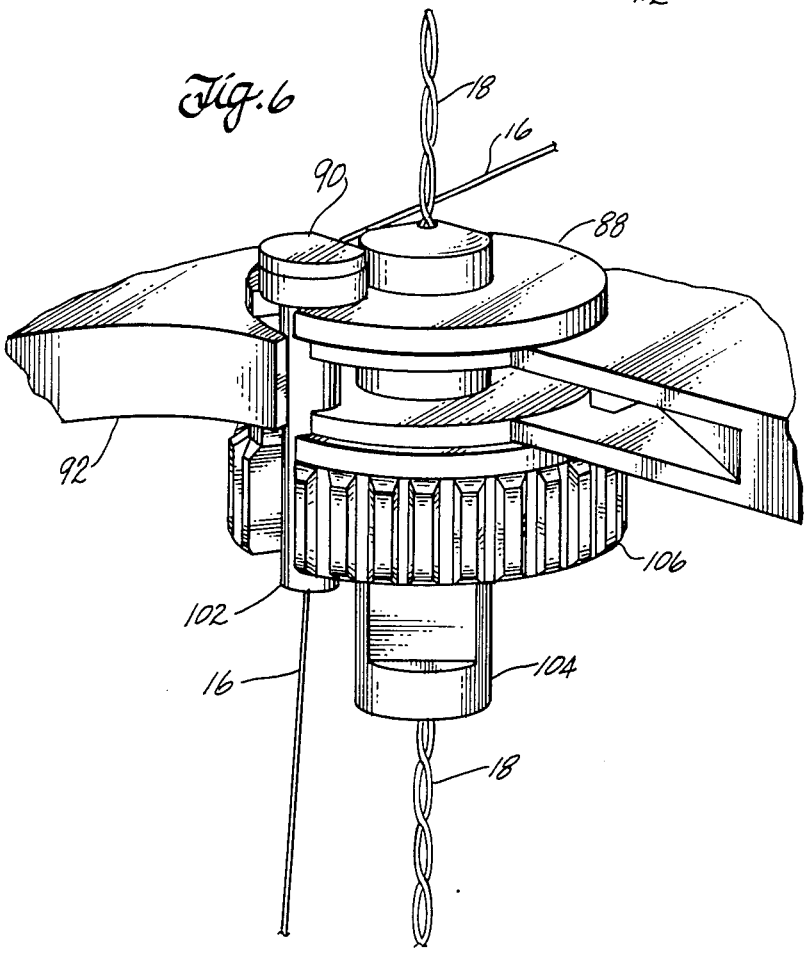
FIG. 6 is a perspective view of a weaving head assembly.

A further illustration of the weaving head assembly is seen in the perspective view of FIG. 6. The wrap wire 16 extends upwardly through a passage in shaft 102. The wrap die 90 is shown mounted on top of shaft 102 with the wrap wire 16 extending upwardly and obliquely away from the wrap die 90 past strand wire 18. Strand wire 18, which in this figure is a twisted double strand, likewise extends upwardly through a passage in shaft 104 which extends through disk 88. Driving power is supplied by drive shaft 36, which extends upwardly to the weaving area and provides rotational power by means of a gear drive train to gear 106 to thereby provide rotational motion to the drive disks for the wrap dies 90. As the weaving head rotates about shaft 104 under the drive of disk 88, wrap wire 16 is wrapped around strand wire 18.

Figure 9:
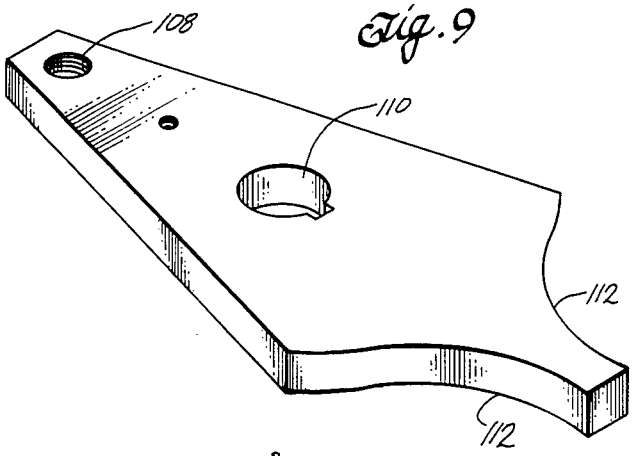
FIG. 9 is a perspective view of a typical shuttle used in the supply stage and in the wire-weaving stage.

A specific configuration of the shuttle which is used in both the supply area for guiding the traverse of the spool baskets containing the spools of wrap wire and the shuttle to guide the weaving heads in the weaving assembly area is shown in perspective view in FIG. 9. A threaded aperture 108 enables the tail 91 of the shuttle mechanism to be mechanically bolted to the shuttle tie rods. A keyhole slot 110 receives a mounting rod to provide the point of rotation about which the shuttle oscillates back and forth. The shuttle is provided with specially contoured surfaces 112 which, in cooperation with the slots 70, 96 in the drive disks and the circular perimetric contour of the disks themselves, provide a smooth point of transition for studs 82, 102 on the drive disks 68 and the weaving head disks 88 to thereby enable the transfer of spool baskets and weaving heads from disk to disk in the wire supply and wire weaving stages. The camming mechanism 116 and the camming pattern 114 utilized to drive the shuttles are shown in plan view in FIG. 7. As shown therein, mechanism 116 includes a cam housing 113 and a cam 115 having the camming pattern 114 contoured into its perimeter. The cam housing 113 is adapted to rotate about axis 118 under the impetus of the appparatus drive motor. A typical shuttle 120 is pivotable about shaft 122 and is provided with a cam follower 124 which is rotatably secured to the base or tail of the shuttle and extends downwardly into a channel surrounding cam 115. A shuttle tie rod 126 is attached to shuttle mechanism 120.

Figure 7:
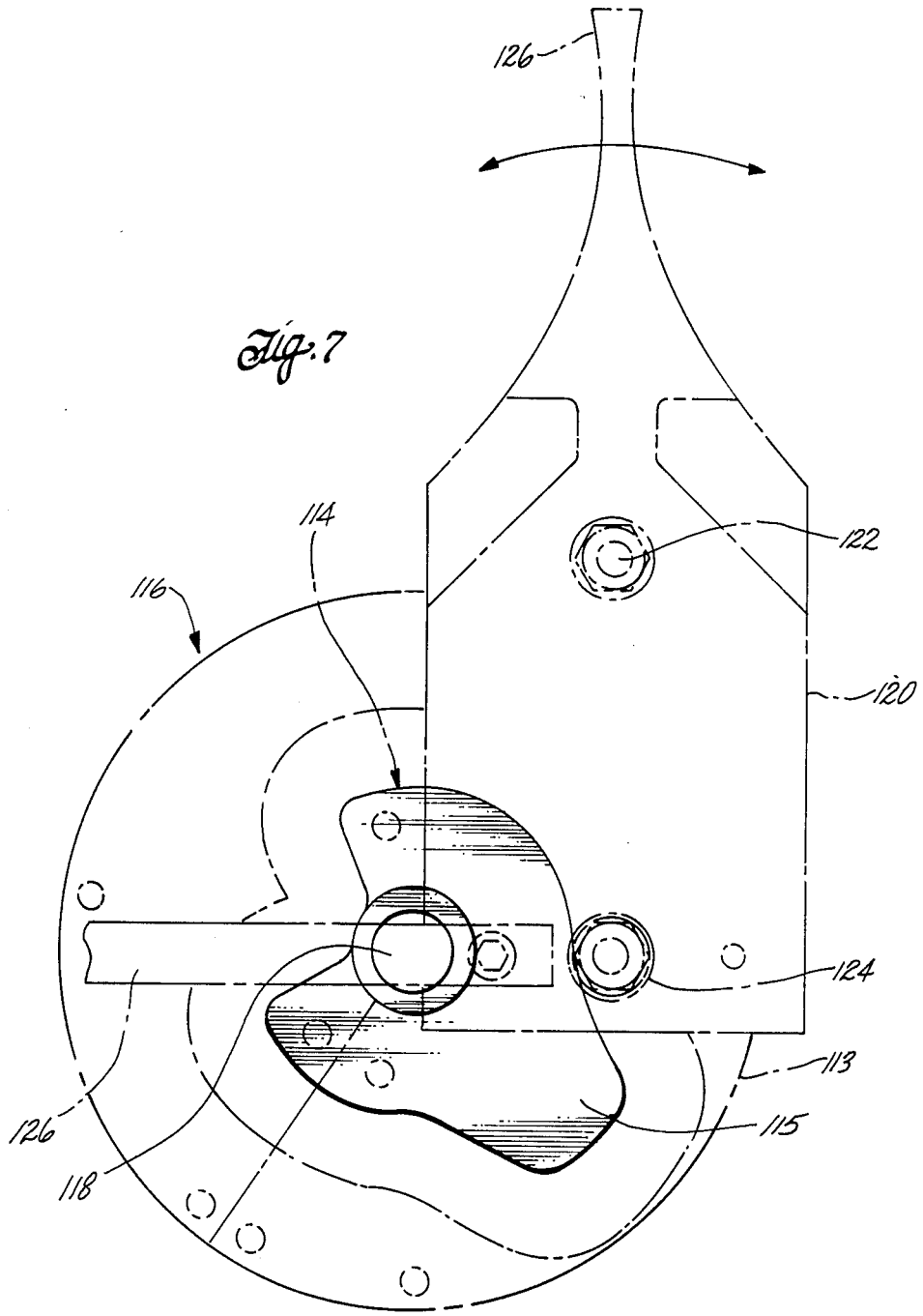
FIG. 7 is a plan view of a cam and cam follower for moving a shuttle used in the wire-supply stage and wire-weaving stage.

As the cam follower 124 follows pattern 114 of the cam 115, shuttle mechanism 120, and in particular the forward tip 126, pivots first to the left from the position shown in FIG. 7 and then reverses its direction of rotation as the cam rotates to pivot to the left. As illustrated in FIGS. 1–3, shuttle tie rods interconnect a plurality of shuttles to gang drive the shuttles as the camming apparatus operates through its cycle. The camming apparatus is mechanically linked to a second set of shuttle tie roads located on the sides of the supply and weaving stages, respectively, opposite the first set of tie rods and shuttles. The camming motion is imparted mechanically to the shuttles in the weaving stage in exactly the same pattern as is imparted to the supply stage.

Figure 8B:
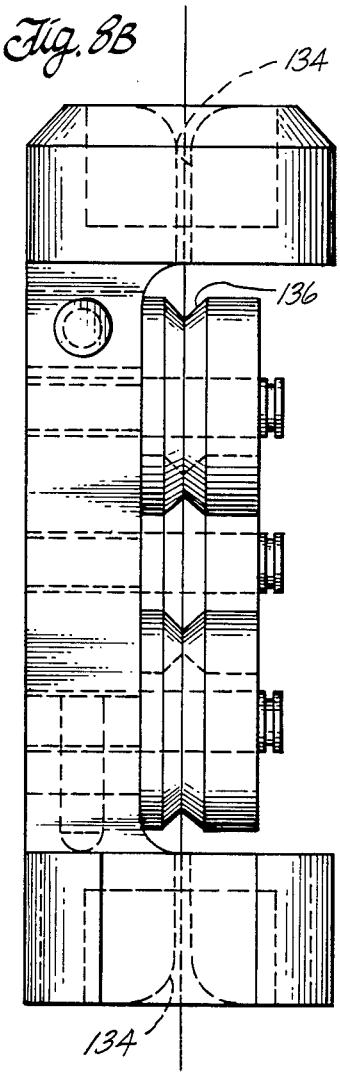
FIG. 8B is a side elevational view thereof.
Figure 8A:
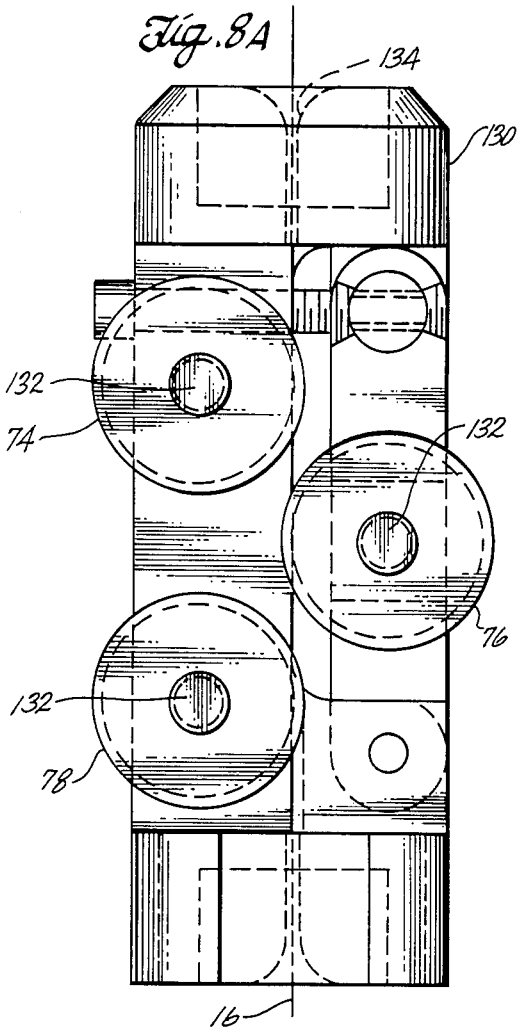
FIG. 8A is a front elevation view of a wrap-wire tensioning assembly.
Figure 8C:
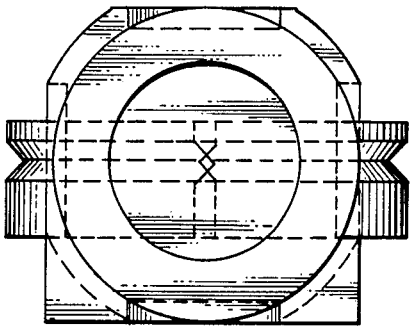
FIG. 8C is an end view of the assembly shown in FIG. 8A.

The details of the tensioning mechanism for the wrap wires are shown in FIGS. 8A, 8B, and 8C. A housing 130 for the tensioning mechanism provides a trio of axes 132 about which rollers 74, 76 and 78 turn. The wrap wire 16 moves through a passage 134 in housing 130 and engages circumferential grooves 136 in the periphery of rollers 74, 76, and 78. Rollers 74, 76, and 78 are positioned relative to the line of travel of the wire so as to exert lateral pressure on the wrap wire 16 and thereby cause the wire to deviate slightly from the vertical to thereby exert pressure on the wire and allow the tensioning mechanism to maintain drag and tension on the wire as it is being drawn from its supply spools to the weaving head stage.

Figure 10:
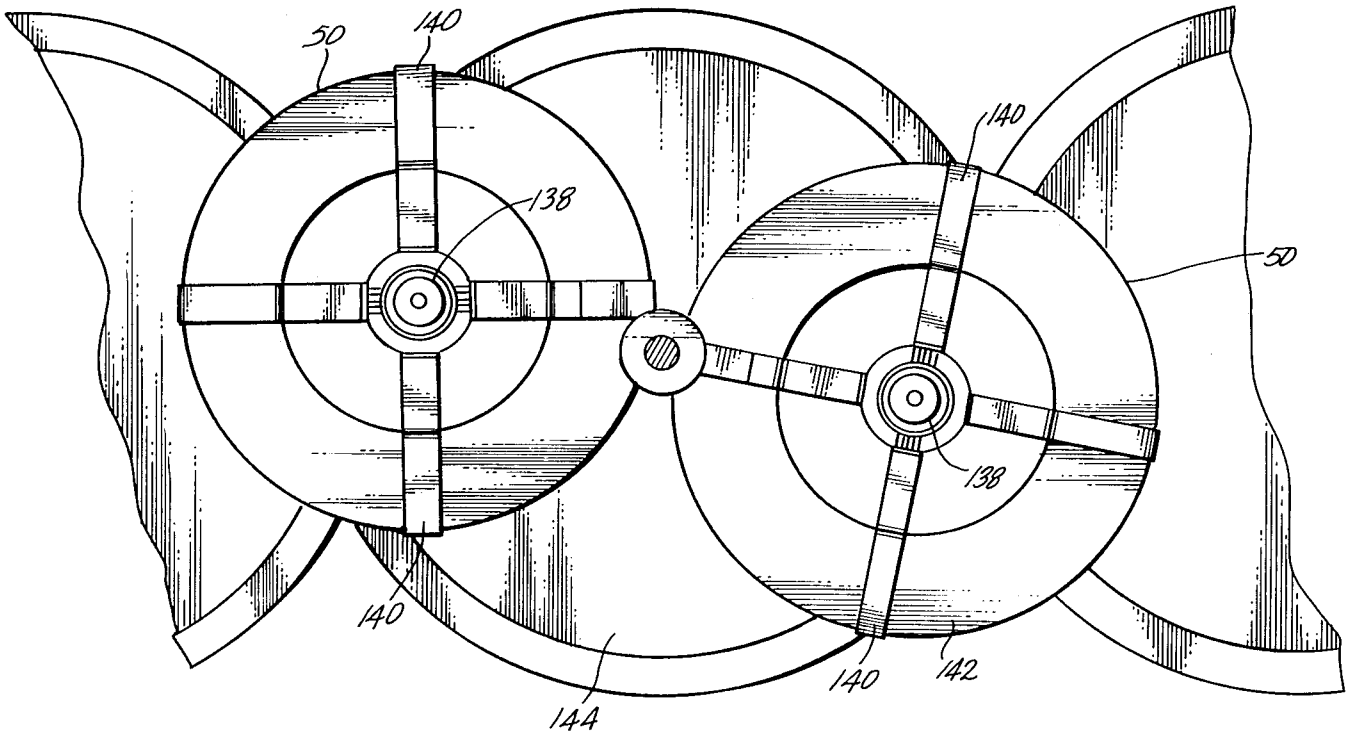
FIG. 10 is a plan view of a pair of wrap-wire supply baskets.

A detailed plan view of two spool baskets 50 for holding spools of wrap wire 16 is shown in FIG. 10. The baskets 50 rotate around shafts 138. Straps 140 are provided at the top of each basket which are hinged at one end and locked at the other in a catch arrangement located adjacent to shaft 138. Unlocking of the straps and rotating same to the upright position enables the insertion and replacement of spent or empty spools when the supply of wrap wire has been totally withdrawn therefrom.

In typical apparatus according to the present invention, the baskets are approximately 15 inches in height and 15 inches in diameter and accommodate a spool of wire that is approximately 6000 feet in length. The ability to utilize such large spools and the significant lengths of wire that can be stored on such spools are a significant advantage of the present invention. In the apparatus according to the present invention, the supply spools need to be replaced on a relatively infrequent basis; thus the number of intervals of downtime are reduced and the number of times in which the lead end of a new supply of wrap wire has to be butt-welded to the trailing end of the previous supply is significantly reduced.

The drive disks upon which the baskets rest are themselves approximately 16 inches in diameter and are fabricated from steel plates approximately 2 inches in thickness. Materials of this size and strength are needed because of the extremely high mechanical forces which are imposed by the apparatus due to the weight of the wire spools and the speed of operation of the equipment.

Figure 11A:
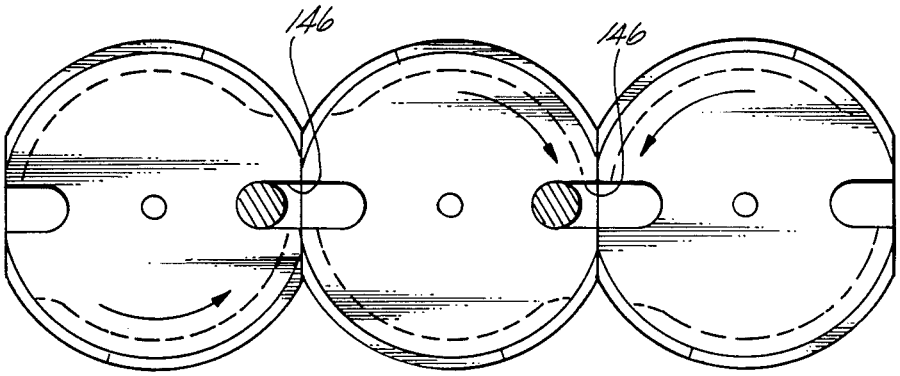
FIGS. 11A, B, C, and D are plan views illustrating various stages of shuttle operation in a typical complete wire-wrap sequence.
Figure 11B:
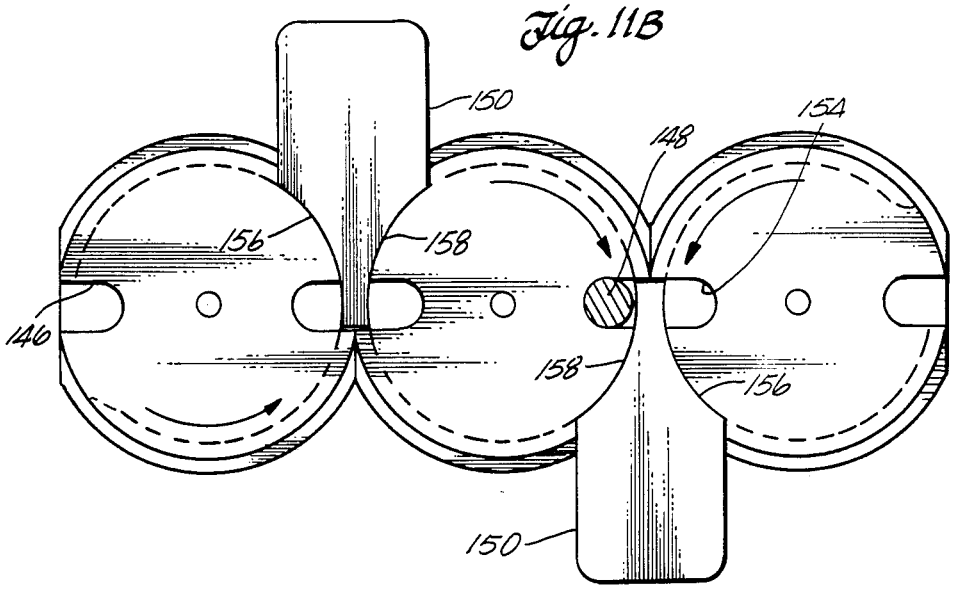
Figure 11C:
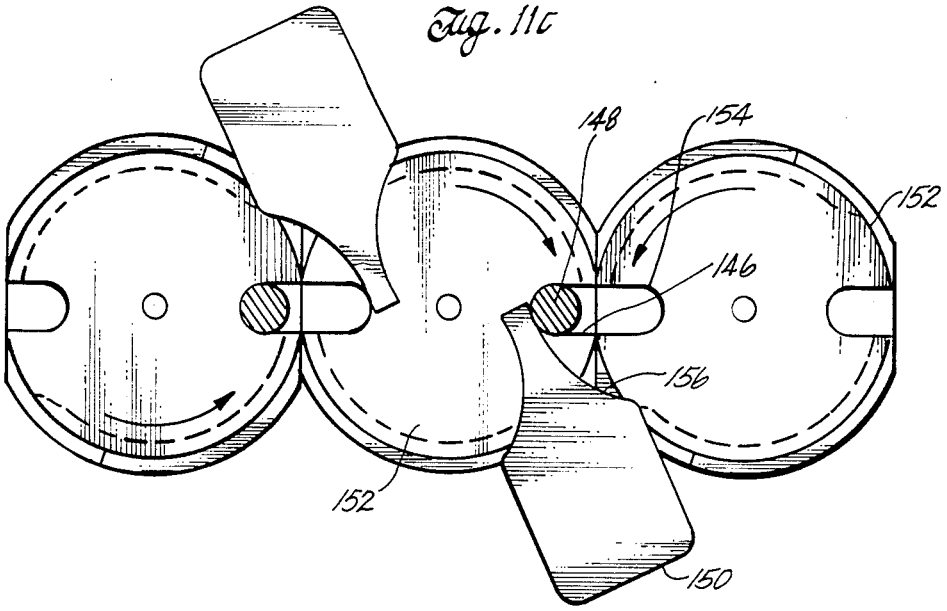
Figure 11D:
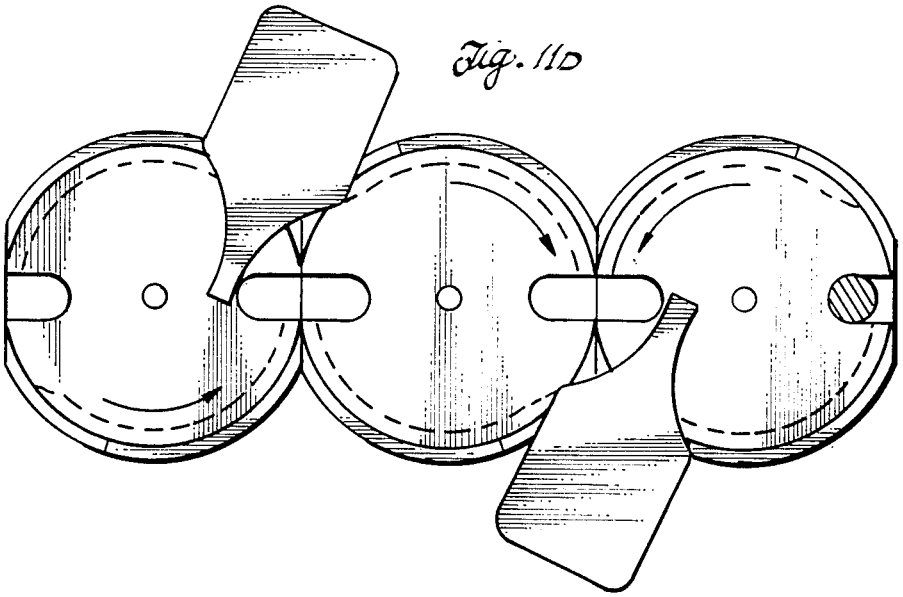

The diagrams of FIGS. 11A, B, C, and D illustrate the sequence of shuttle operation. This sesquence is applicable to the shuttling of spool baskets of wrap wire in the supply area and the shuttling of weaving heads in the weaving area. As seen therein, the drive disks are shown each rotating in a direction opposite to the drive disks on either side. Each disk is provided with two slots for receiving the shaft or stud of the drive disk on which the spool supply basket or the disk on which the weaving head is mounted. In FIG. 11B, shuttles 150 are shown in their normal position, and it can be seen that the camming surfaces 156, 158 of the shuttles have the same radius of curvature as the disks, so that the shafts 148 ride smoothly along the camming surfaces 156, 158 of the shuttles and remain confined in slots 146. When transfer of the spool basket or the weaving head is desired, the shuttle tie rods on one side of the apparatus move to the right, causing the tips of the shuttles to pivot to the left. At the same time, the shuttle tie rods on the opposite side move in the opposite direction, causing the shuttles to pivot toward the center of the drive disk from the opposite side thereof. As seen in FIG. 11C, when shaft 148 rotates into contact with surface 156 of shuttle 150, the shaft rides along surface 156 as the slot 146 and disk 152 rotate downwardly, thus causing the shaft 148 to transfer from the surface of the shuttle into slot 154. In the next sequence, shown in FIG. 11D, the shuttle tie rods move in the opposite direction, causing the shuttles 150 to pivot in the opposite direction, setting the stage for transfer of the next set of spool supply baskets and weaving heads.

Figure 12:
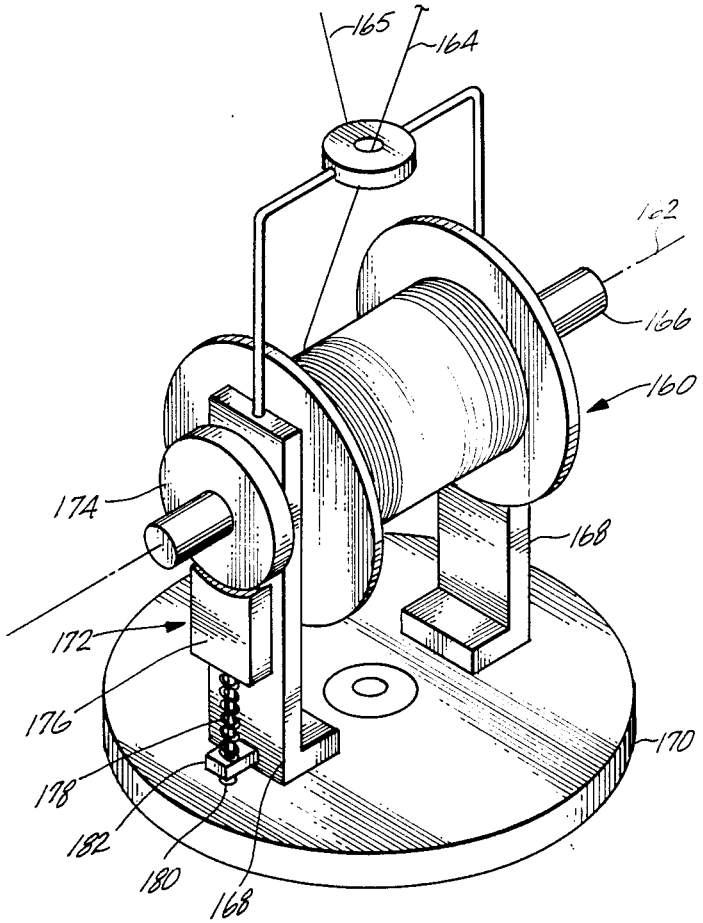
FIG. 12 is a perspective view of an alternate embodiment of a wrap-wire supply spool.

An alternative embodiment of a wrap-wire spool 160 according to the present invention is shown in FIG. 12. As shown therein, the spool is mounted with its longitudinal axis of rotation 162 in a horizontal orientation in contrast to the vertical orientation of the wrap-wire spools shown in FIGS. 1–3. The wire 164 on spool 160 is wound conventionally about a central core of the spool. Spool 160 is rotatably mounted on a shaft 166 which is in turn held in position by a pair of upright supports 168.

As the fence-making apparatus of the present invention operates utilizing horizontal spools such as spool 160, wire 164 is drawn from the exterior of the spool as it rotates about the axis 162. Wire 164 is guided upwardly from spool 160 by a conventional fair lead 165 toward the weaving area. A drag brake 172 comprising a disk 174 mounted on shaft 166 and a brake pad 176 controls the speed at which wire from 160 unwinds and prevents coil overrun. Brake pad 176 is supported by coil spring 178 and shaft 180 in slipping frictional contact with disk 174. Coil spring 178 is held in compression by means of support 182.

In this alternate embodiment of the fence-making apparatus of the present invention, a plurality of spools 160 in a horizontal orientation are used in place of the plurality of vertically oriented wrap-wire supply spools shown in FIGS. 1–3. In all other aspects, the operation of the fence-making apparatus is as previously described.

Figure 13A:
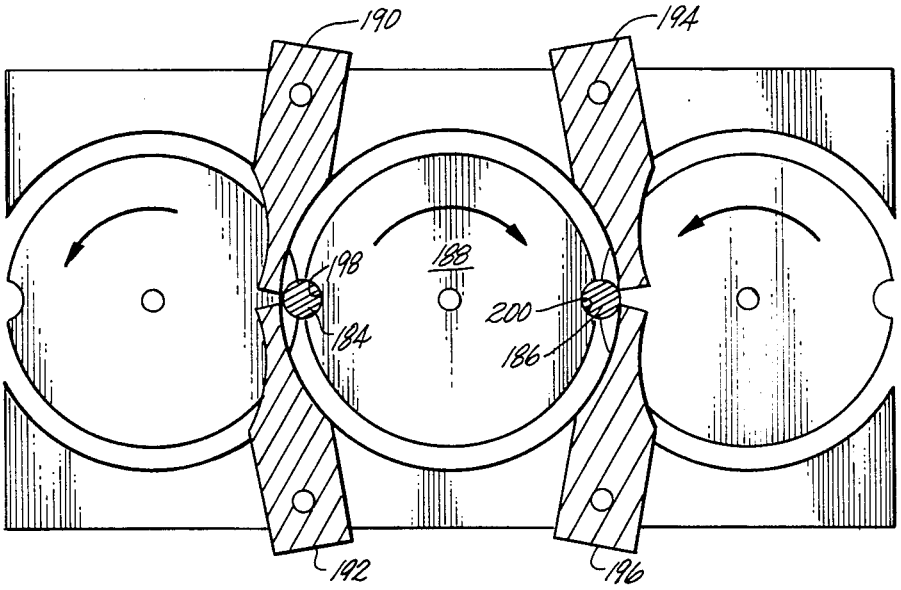
FIGS. 13A and 13B are plan views illustrating an alternate embodiment of the wrap wire driving discs and stages of shuttle operation in a wrap-wire sequence.
Figure 13B:
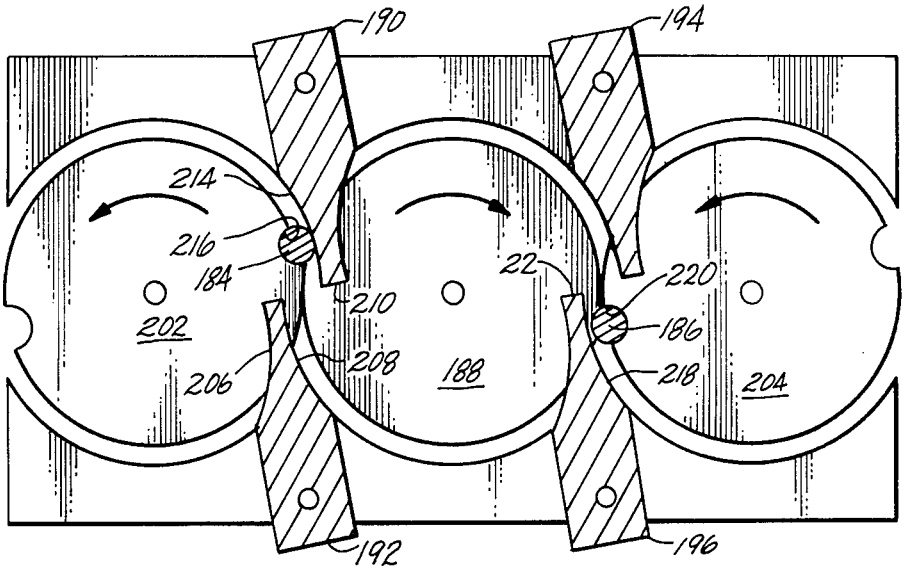

An alternate embodiment of drive disks and shuttle operation is shown in FIGS. 13A and 13B. In this embodiment, the driving slots are semicircles cut into the periphery of the drive disks. Each disk is provided with two such slots. As before, adjacent drive disks rotate in a direction opposite to the direction of rotation of the disks on either side.

In the embodiment shown in FIGS. 13A, 13B, basket wrap-wire studs 184, 186 are shown in engagement with and under the drive of disk 188. Studs 184, 186 are maintained in operative engagement with the pair of semicircles in disk 188 by a first pair of shuttles 190, 192, a second pair of shuttles 194, 196, and the peripheral boundary of the assembly in which the drive disk is mounted. In comparison to the embodiment of FIGS. 1–3, approximately double the number of shuttles are required in order to provide the bearing surfaces to hold wrap-wire basket studs such as studs 184, 186 in semicircular shaped slots 198, 200 in disk 188 and to facilitate the smooth transfer of the studs to disks 202 and 204 respectively as shown in FIG. 13B.

In this embodiment, the camming surfaces of the shuttles, for example, surfaces 206, 208 of shuttle 192 have a radius of curvature greater than the drive disks to accommodate the half portion of the drive stud which protrudes from the semicircular slots in the drive disks. When transfer of the wire-wrap holders is desired, a pair of shuttles such as shuttles 190 and 196 pivot, causing the tips 210, 212 thereof to pivot right and left respectively. Shuttles 192 and 194 remain in the same position. When stud 184 rotates into contact with surface 214 of shuttle 190, the stud rides along surface 214 as slot 216 in disk 202 rotates upwardly, thus causing stud 184 and the holder attached to the stud to transfer to disk 202. At the same time stud 186 is transferred to disk 204 in the same manner. Stud 186 comes into contact with surface 218 on shuttle 196 as slot 220 in disk 204 rotates downwardly and thus transfers to disk 204.

This alternate embodiment of wrap-wire drive disks and shuttles enables the use of larger diameter wrap-wire coils since the driving slots in the disks are smaller and do not extend as deeply into the interior of the drive disks. The semicircular slots also provide a shorter distance of travel of the drive studs as the studs transfer from the slot of one disk to the adjacent disk.

The present invention has been described in the foregoing specification in the context of a primary application, namely the fabrication of diamond-mesh fencing, more specifically known and referred to as 37 Elwood fabric." Other applications are also contemplated, including the fabrication of wire netting and other wire fabric assemblages including gabions. In such applications, as with the primary application, the specific configuration of the fencing is dictated by the use to be made of the wire fabric produced and by the choice of the designer. In some applications, a single wire in each strand wire position is replaced with a double or triple strand of wire in which the individual wires are twisted or braided together. Likewise the size and shape of the spaces or interstices defined by the strand and wrap wires can likewise be varied depending on the speed of the shuttle and transfer mechanisms relative to the speed of the wire fabric take-up mechanism. The specific pattern of the camming mechanism of the present invention can likewise be modified to produce multiple wraps of wrap wire about a strand wire before the shuttle and transfer mechanism moves the sources of wrap wire to adjacent disks.

What is claimed is:

1. A wire-weaving apparatus comprising:

a first stage including a plurality of sources of wrap wire and plurality of sources of strand wire;

first means for shuttling the sources of wrap wire horizontally about the strand wires in a weaving pattern;

a second stage including a plurality of weaving heads remotely spaced from the first stage;

second means for shuttling the weaving heads horizontally about the strand wires in a weaving pattern;

means for pulling the wrap wires and strand wires from the first stage to the second stage; and means for synchronizing the operation of the first and second shuttling means of the wrap-wire sources and the weaving heads to interweave the wrap wires about the strand wires in a predetermined pattern.

2. An apparatus according to claim 1 wherein the sources of wrap wire and upwardly opening receptacles containing wire coils, said receptacles being mounted on a horizontal table.

3. An apparatus according to claim 2 wherein the sources of strand wire are a plurality of spools mounted below the table.

4. An apparatus according to claim 3 wherein wire is extracted from the interior of the coil of wrap wire upwardly in a longitudinal direction out of the receptacle.

5. An apparatus according to claim 4 including apertures provided in the table for passage of the strand wires from the strand-wire spools upwardly through the first stage and thereafter to the second stage, wherein the apertures are located between the sources of wrap wire.

6. An apparatus according to claim 5 including drive means operatively engaged with the means for shuttling the sources of wrap wire and the means for shuttling the weaving heads.

7. An apparatus according to claim 6 including wire-tensioning means mounted on the sources of wrap wire for applying tension to the wrap wires as the wires move in the space between the first stage and the second stage.

8. An apparatus according to claim 7 including second tensioning means mounted on the table for tensioning the strand wires as the wires move in the interval between the first stage and the second stage.

9. An apparatus according to claim 1 wherein the plurality of sources of wrap wires are spools of wire mounted with their longitudinal axis in a horizontal orientation.

10. An apparatus according to claim 9 wherein the spools of wire are conventionally wound and the wrap wire is withdrawn from the exterior of the spool during the weaving operation.

11. An apparatus according to claim 10 including guide means for guiding the wire from the spool to the second stage.

12. An apparatus according to claim 8 wherein the means for shuttling the sources of wrap wire includes a plurality of horizontally aligned drive disks for supporting the sources of wrap wire, said drive disks being provided with a pair of slots located on diametrically opposite sides of the drive disk.

13. An apparatus according to claim 12 wherein the sources of wrap wire are provided with drive rod means for operative engagement with the slots in said drive disks.

14. An apparatus according to claim 13 including a plurality of pivotally mounted camming means located below the drive disks for intermittently engaging the drive road means and transferring said sources of wrap wire from disk to disk.

15. An apparatus according to claim 14 wherein the drive rod means are connected to the underside of the disks supporting the sources of wrap wires.

16. An apparatus according to claim 15 including means for taking up the woven wire at a location following the second stage.

17. An apparatus according to claim 16 including idler arm means in operative engagement with the woven wire for controlling the speed of take-up of the woven wire.

18. An apparatus for making wire mesh fencing comprising:

a plurality of supply spools of strand wire located at a first stage;

a plurality of strands of linearly aligned spools of wrap wires positioned above the supply spools with the longitudinal axis of each spool being vertically oriented;

a first shuttle and transfer means located at the first stage;

a plurality of receptacles for receiving each of the spools of wrap wires, said receptacles being mounted on the first shuttle and transfer means;

drive means for pulling the strand wires upwardly through the first stage to a second weaving stage and for pulling the wrap wires from the interior of the wrap wire spools upwardly from the first stage to the second stage;

a second shuttle and transfer means located at the second weaving stage which moves in synchronism with the first shuttle and transfer mechanism whereby the wrap-wire spools may be moved back and forth along the line of alignment in a weaving pattern about the strand wires on the first shuttle and transfer mechanism with the second shuttle and transfer mechanism to cause the individual wrap wires to be interwoven and wrapped around the individual strand wires, creating a predetermined geometric-shaped pattern of fencing.

19. The apparatus according to claim 18 including a take-up stage spaced from the second shuttle and transfer mechanism.

20. An apparatus according to claim 19 wherein the first shuttle and transfer mechanism includes a plurality of driving disks, each of said disks being rotatably mounted in a circular bearing housing and each having a pair of diametrically opposed slots formed in the periphery thereof.

21. An apparatus according to claim 20 including a plurality of driving studs, each of said studs extending from one of said wrap-wire receptacles, said studs being engageable in said slots in the driving disks.

22. An apparatus according to claim 21 including a shuttle of a predetermined configuration pivotally mounted adjacent the driving disks for providing a bearing surface for the studs to transfer said studs from slot to slot on adjacent driving disks.

23. An apparatus according to claim 22 including cam means operatively engaged with the shuttle and transfer for driving each individual shuttle in synchronism with the rotation of the driving disks whereby the wrap-wire receptacles are transferred at high speed from one driving disk to an adjacent driving disk in a smooth and continuous motion.

24. A wire-weaving apparatus comprising:

a first stage including a plurality of sources of strand wire;

a second stage including a plurality of sources of wrap wire spaced from the first stage;

first means located at the second stage for shuttling and transferring the sources of wrap wire horizontally about the strand wires;

a third stage including a plurality of weaving heads remotely spaced from the first and second stage;

second means located at the third stage for shuttling and transferring the weaving heads and wrap wires horizontally about the strand wires in said weaving pattern;

means for pulling the wrap wires from the second stage and the strand wires from the first stage vertically through the second stage to the third stage; and means for synchronizing the operation of the first and second shuttling and transferring means for the wrap-wire sources and the weaving heads respectively to interweave the wrap wires about the strand wires at the third stage in a predetermined pattern.

25. An apparatus according to claim 24 wherein the sources of wrap wire are upwardly opening receptacles containing wire coils, said receptacles being mounted on a horizontal table.

26. An apparatus according to claim 25 wherein the sources of strand wire are a plurality of spools mounted below and spaced from the horizontal table.

27. An apparatus according to claim 26 wherein wire is extracted from the interior of the coils of wrap wire upwardly in a longitudinal direction out of the receptacle.

28. An apparatus according to claim 27 including apertures provided in the horizontal table for passage of the strand wires from the strand-wire spools upwardly through the first stage and thereafter to the second stage, said apertures being located between the sources of wrap wire.

29. An apparatus according to claim 28 including drive means operatively engaged both with the first means for shuttling and transferring the sources of wrap wire and with the second means for shuttling and transferring the weaving heads.

30. An apparatus according to claim 28 including means for taking up the woven wrap and strand wires at a location following the third stage.

31. An apparatus according to claim 30 including idler arm means in operative engagement with the woven wires for controlling the speed of take-up of the woven wires.

32. An apparatus for making wire mesh fencing comprising:

a plurality of supply spools of strand wire positioned at a first location;

a plurality of linearly aligned spools of wrap wires positioned above and spaced a predetermined distance from the supply spools along a general line of alignment at a second location, the longitudinal axis of each wrap wire spool being vertically oriented;

a plurality of receptacles for receiving each of the spools of wrap wires at said second location, said receptacles being mounted on a first shuttle and transfer means whereby the receptacles are caused to move in a predetermined pattern about the strand wire during operation;

drive means for pulling the strand wires upwardly from the first location through the second location to a third location and for pulling the wrap wires from the interior of the wrap wire spools upwardly from the second location to the third location, said third location being spaced a predetermined distance from the first and second locations;

a second shuttle and transfer means located at the third location which moves in synchronism with the first shuttle and transfer mechanism whereby the wrap-wire spools are moved generally along the line of alignment in a weaving pattern about the strand wires by the first shuttle and transfer means and the second shuttle and transfer means moves the wrap wires along a parallel line of alignment to cause the individual wrap wires to be interwoven and wrapped around the individual strand wires, creating a predetermined geometric-shaped pattern of fencing.

33. The apparatus according to claim 32 including a take-up stage spaced from the second shuttle and transfer means.

34. An apparatus according to claim 33 wherein the first shuttle and transfer means includes a plurality of driving disks, each of said disks being rotatably mounted in a circular bearing housing and each having a pair of diametrically opposed slots formed in the periphery thereof.

35. An apparatus according to claim 34 including a plurality of driving studs, each of said studs extending from one of said wrap-wire receptacles, said studs being engageable in said slots in the driving disks.

36. An apparatus according to claim 35 including a shuttle of a predetermined configuration pivotally mounted adjacent the driving disks for providing a bearing surface for the studs to transfer said studs from slot to slot on adjacent driving disks.

37. An apparatus according to claim 36 including cam means operatively engaged with the first shuttle and transfer means for driving each individual shuttle in synchronism with the rotation of the driving disks whereby the wrap-wire receptacles are transferred at high speed from one driving disk to an adjacent driving disk in a smooth and continuous motion.

* * * * *